US006645537B2

(12) United States Patent
Sweeney et al.

(10) Patent No.: US 6,645,537 B2
(45) Date of Patent: Nov. 11, 2003

(54) BEVERAGE FILTER CARTRIDGE

(75) Inventors: Richard Sweeney, Winchester, MA (US); Nicholas G. Lazaris, Newton, MA (US); Roderick H. Beaulieu, Cumberland, RI (US); William P. Bucuzzo, Haverhill, MA (US)

(73) Assignee: Keurig, Incorporated, Wakefield, MA (US)

( * ) Notice: Subject to any disclaimer, the term of this patent is extended or adjusted under 35 U.S.C. 154(b) by 147 days.

(21) Appl. No.: 09/782,622

(22) Filed: Feb. 13, 2001

(65) Prior Publication Data

US 2002/0020659 A1 Feb. 21, 2002

Related U.S. Application Data

(60) Provisional application No. 60/183,708, filed on Feb. 18, 2000.

(51) Int. Cl.[7] ..... B65B 29/02

(52) U.S. Cl. ..... 426/79; 426/113; 426/115; 426/433; 99/295; 99/317; 206/6.5; 206/222

(58) Field of Search ..... 426/77, 79, 86, 426/112–113, 115, 590, 394, 431–433; 99/295, 316, 317, 323; 206/0.5, 219, 222

(56) References Cited

U.S. PATENT DOCUMENTS 3,154,215 A * 10/1964 Vesconte ..... 220/97
4,875,620 A * 10/1989 Lane, Sr. ..... 229/1.5 B
5,242,702 A * 9/1993 Fond ..... 426/433
5,243,164 A * 9/1993 Erickson et al. ..... 219/10.55 E
5,325,765 A * 7/1994 Sylvan et al. ..... 99/295
5,738,786 A * 4/1998 Winnington-Ingram ..... 210/474
5,840,189 A 11/1998 Sylvan et al. ..... 210/474

FOREIGN PATENT DOCUMENTS

DE 1536372 1/1970
GB 2023086 A * 12/1979

* cited by examiner

*Primary Examiner*—Drew Becker
(74) *Attorney, Agent, or Firm*—Samuels, Gauthier & Stevens

(57) ABSTRACT

A beverage filter cartridge includes a cup-shaped outer container with a bottom and a side wall extending upwardly from the bottom wall to a circular rim surrounding an upper opening. The side wall has an upper section extending downwardly from the rim to an intermediate section, and a tapered lower section configured to provide a plurality of circumferentially spaced flutes extending downwardly from the intermediate section to the bottom wall. A filter element subdivides the interior of the container into first and second chambers. A beverage medium is stored in the first chamber. A cover is joined to the side wall at the rim to close the upper opening. The cover is yieldably piercable to accommodate an injection of liquid into the first chamber for combination with the beverage medium to produce a beverage. The filter element is permeable to accommodate a flow of the beverage from the first chamber into the second chamber, and the bottom wall is yieldably piercable to accommodate an outflow of the beverage from the second chamber to the exterior of the cartridge.

8 Claims, 5 Drawing Sheets

BEVERAGE FILTER CARTRIDGE

CROSS REFERENCE TO RELATED APPLICATIONS

This application claims priority from Provisional Patent Application Ser. No. 60/183,708 filed Feb. 18, 2000.

FIELD OF THE INVENTION

This invention relates to disposable single serve beverage filter cartridges.

DESCRIPTION OF THE PRIOR ART

A known disposable single serve beverage filter cartridge is disclosed in U.S. Pat. Nos. 5,325,765 and 5,840,189 (Sylvan et al.), dated respectively Jul. 5, 1994 and Nov. 24, 1998, the disclosures of which are herein incorporated by reference.

This beverage filter cartridge is comprised basically of an impermeable yieldably-piercable cup-shaped outer container internally subdivided by a permeable cone-shaped filter into first and second chambers. A granular or powdered dry beverage medium, e.g., roasted ground coffee, is stored in the first chamber, and the container is closed by an impermeable yieldably piercable lid.

During a processing cycle, the lid and container bottom are pierced, respectively, by tubular inlet and outlet probes. The inlet probe admits heated liquid under pressure into the first chamber for infusion with the beverage medium, and the resulting brewed beverage passes through the filter into the second chamber from which it exits via the outlet probe for delivery to an underlying cup.

This known beverage filter cartridge has gained rapid and increasingly widespread acceptance, notwithstanding several problems that have persisted since its initial introduction. One such problem stems from a tendency of the container side wall to buckle under the force exerted by the outlet probe as it pierces the container bottom. This sometimes results in a failure of the outlet probe to achieve bottom penetration, thus aborting the brewing process because the brewed beverage cannot be delivered to the underlying cup. Buckling of the container side wall also can distort the punctured orifice in the container bottom, thus compromising sealing and resulting in leakage of the brewed beverage.

Problems have also been encountered in reliably sealing the rim of the filter component to the interior side wall of the container, as well as in centrally securing the bottom of the filter component to the container bottom. Failure to achieve a proper rim seal can cause the unsealed portion of the filter to collapse under brew pressure, resulting in the brewed beverage being contaminated by beverage medium residue escaping from the collapsed filter. By the same token, contamination of the brewed beverage also can occur if the filter bottom is not centrally secured, resulting in the filter being punctured by the outlet probe as it projects upwardly through the container bottom. Contamination of the brewed beverage also occurs occasionally when a filter element bursts under the pressure exerted by the heated liquid being infused with the beverage medium.

Still another problem stems from heat sealing the upper rim of the filter at or closely adjacent to the upper rim of the container side wall. This increases the unoccupied so called "head space" between the outside of the filter and the surrounding container wall, and also limits the maximum amount of beverage medium that can be stored in the cartridge to that which can be contained within the filter. In some cases, this can compromise the strength of the resulting brewed beverage. Beverage strength can be optimized by filling the filter to its maximum capacity, but this can result in errant granules of the beverage medium spilling onto the container rim. This in turn can disrupt the integrity of the seal between the cover and the container rim.

Among the objectives of the present invention is a strengthening of the container side wall to thereby resist buckling when the container bottom is punctured by the outlet probe of the brewer.

Companion objectives include a beneficial increase in beverage medium storage capacity, improvements in the manner in which the filter component is sealed to and radially supported by the container side wall, as well as improvements in the manner in which the lower end of the filter is positioned and anchored to the cartridge bottom.

SUMMARY OF THE INVENTION

In accordance with the present invention, the container side wall is provided with circumferentially spaced flutes which are strategically positioned to enhance resistance to buckling without interfering with or compromising the integrity of the seal between the side wall and the filter component. The location at which the filter component is joined to the interior side wall of the container is lowered to achieve a beneficial increase in beverage medium storage capacity. This location is defined by a tapered circular ledge against which the tapered filter component is reliably sealed.

The channels formed between the circumferentially spaced flutes serve to efficiently direct the brewed beverage downwardly towards the pierced container bottom, with an accompanying beneficial increase in turbulence in the head space defined between the filter element and container side wall.

In a second embodiment of the invention, the container bottom is configured to provide a downwardly protruding centrally disposed boss defining a reduced diameter interior sump surrounded by an annular planar bottom area. The annular bottom area is available for piercing by the outlet probe. The filter projects downwardly into and is secured within the sump at a location safely out of harms way with respect to the piercing action of the outlet probe. A beneficial decrease in head space is also realized by locating the lower end of the filter in the reduced diameter sump.

In a third embodiment of the present invention, the circumferentially spaced flutes protrude sufficiently inwardly into the container interior to radially contact the filter element at circumferentially spaced locations. This radial contact beneficially guides the filter element into its centrally located position during assembly of the cartridge components, and, during the processing cycle, provides radial support which resists distortion and possible bursting of the filter element.

These and other features, objectives and advantages of the present invention will now be described in greater detail with reference to the accompanying drawings, wherein:

DETAILED DESCRIPTION OF PREFERRED EMBODIMENT

Figure 2:
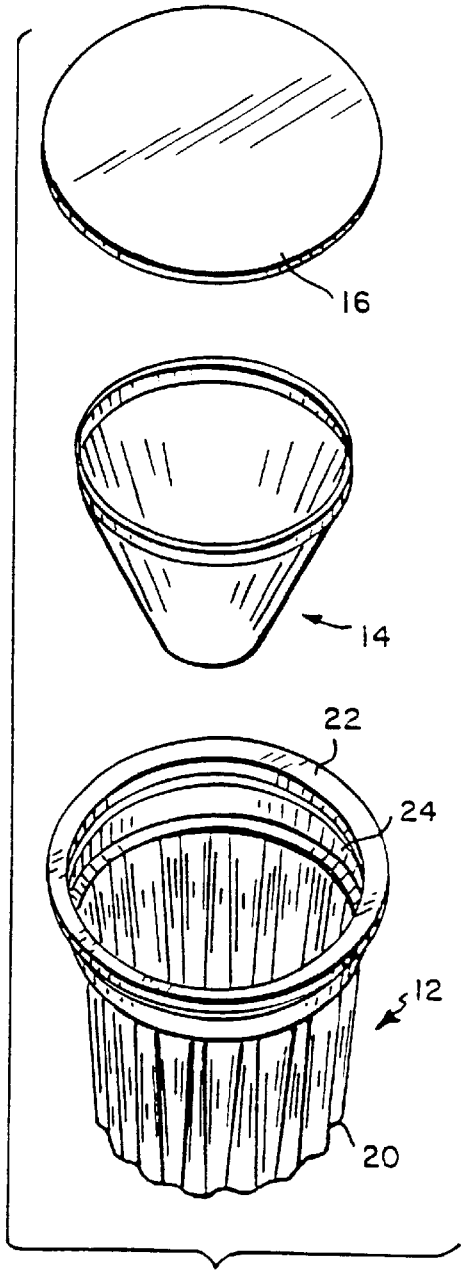
FIG. 2 is an exploded perspective view of the basic components of the beverage filter cartridge shown in FIG. 1.
Figure 4:
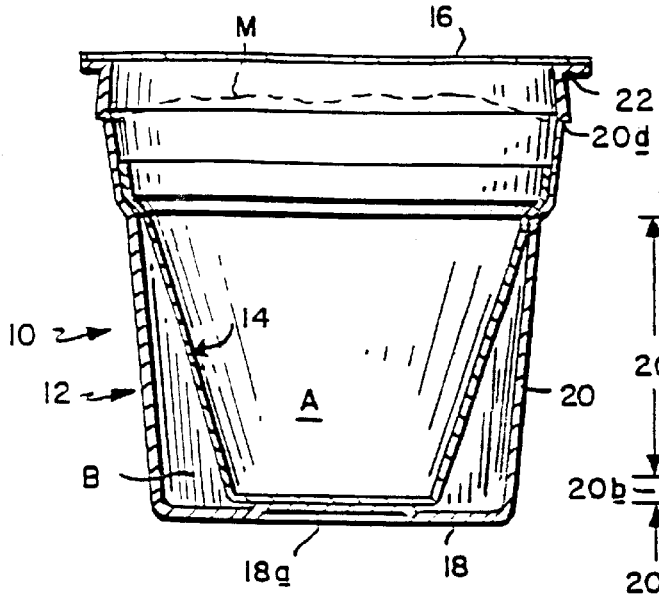

With reference initially to FIGS. 1–5, a beverage filter cartridge in accordance with a first embodiment of the invention is generally depicted at 10. As shown in FIG. 2, the basic components of the beverage filter cartridge include an outer cup-shaped container 12, a generally cone-shaped filter element 14, and a planar circular lid 16.

Figure 6:
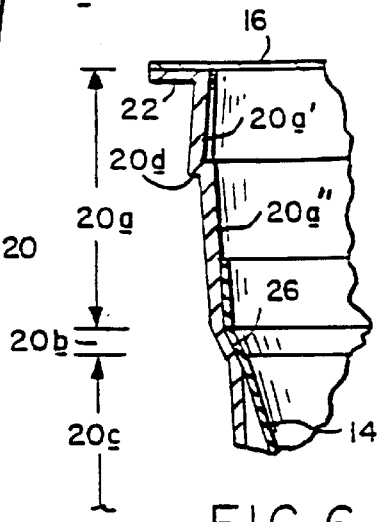
FIG. 6 is an enlarged sectional view of a rim portion of the filter cartridge as shown in FIG. 4.
Figure 7:
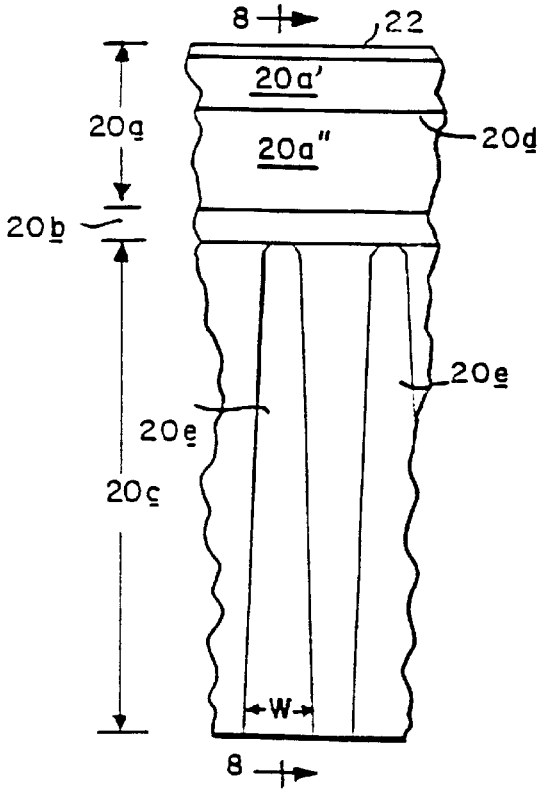
FIG. 7 is an enlarged view of a portion of the side wall of the beverage cartridge.
Figure 8:
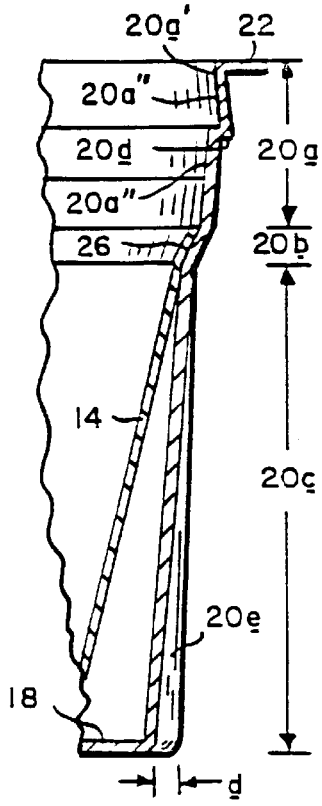
FIG. 8 is a sectional view taken along line 8—8 of FIG. 7.

The cup-shaped container 12 has a bottom 18, and a side wall 20 extending upwardly from the bottom to a circular rim 22 surrounding an upper opening 24. With reference additionally to FIGS. 6–8, it will be seen that the side wall 20 has an upper section 20*a* extending downwardly from the rim 22 to an intermediate section defined by an inwardly tapered ledge 20*b*, and a lower tapered section 20*c* extending downwardly from ledge 20*b* to the bottom 18.

The upper wall section 20*a* is preferably subdivided into upper and lower segments 20*a*' and 20*a*". Moving down the cup, segment 20*a*' is flared outwardly, and segment 20*a*" tapers inwardly, with the juncture therebetween defining a stacking shoulder 20*d*. The bottom 18 is optionally and preferably provided with an upwardly protruding central boss 18*a*.

The lower tapered wall section 20*c* is configured to provide a plurality of circumferentially spaced flutes 20*e*, the upper ends of which terminate beneath the intermediate section defined by ledge 20*b*, and the lower ends of which terminate as indentations in the bottom wall 18.

It will be seen from FIG. 8 that the depths "d" of the flutes 20*e* gradually increase from a minimum at their upper ends to a maximum at their lower ends. Likewise, as can be seen from FIG. 7, the widths "w" of the flutes also gradually increase from a minimum at their upper ends to a maximum at their lower ends.

The cup-shaped container is preferably thermo-formed vacuum molded from an impermeable yieldably piercable heat sealable material having a nominal thickness of 0.031" and comprising, for example, polyethylene/EVOH/polystyrene supplied by Curwood Packaging of Oshkosh, Wis., U.S.A.

The filter element 14 is formed of a pliable and permeable heat sealable material such as for example cellulose polypropylene supplied by J. R. Crompton, Ltd of Bury, Lancashire, England. The bottom of the filter element is supported on and secured as by heat sealing to the central boss 18*a*.

The lid may be cut or blanked from any suitable impermeable heat sealable and yieldably piercable material, such as for example, a metallic/polymer laminate supplied by Winpak Heat Seal Packaging, Inc. of Montreal, Canada.

As can best be seen in FIG. 6, the filter element is heat sealed as at 26 to the intermediate wall section defined by tapered ledge 20*b*. The taper angle of the ledge 20*b* closely approximates the taper angle of the filter element 14, thereby facilitating the task of securely and reliably heat sealing the two together. The filter element serves to subdivide the interior of the container 12 into first and second chambers A, B. A dry granular or powdered beverage medium "M", typically ground roasted coffee, is stored in chamber A, and the container opening 24 is closed by heat sealing the lid 16 to the rim 22.

Figure 1:
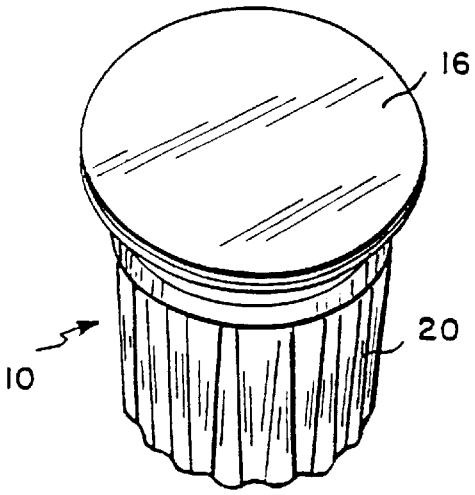
FIG. 1 is a perspective view of a disposable beverage filter cartridge in accordance with one embodiment of the present invention.
Figure 3:
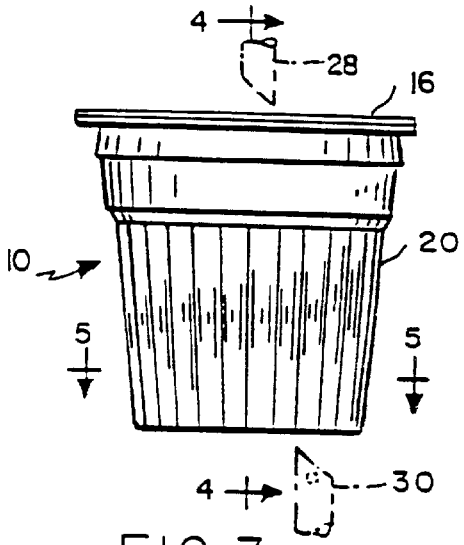
FIG. 3 is a side elevational view of the beverage filter cartridge shown in FIG. 1.
Figure 5:
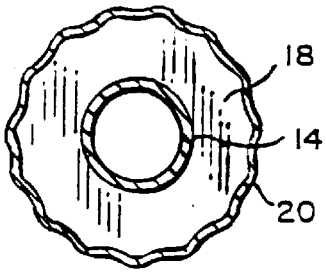
FIGS. 4 and 5 are vertical and horizontal sectional views taken, respectively, on lines 4—4 and 5—5 of FIG. 3.

At the onset of a processing cycle, the lid 16 and container bottom 18 are pierced, respectively, by tubular inlet and outlet probes 28, 30 (see FIG. 3). The inlet probe 28 admits a heated liquid, typically hot water, into chamber A where it infuses and combines with the beverage medium M to produce a beverage. The beverage passes through the filter element 14 into chamber B, from which it exits via outlet probe 30.

Figure 9:
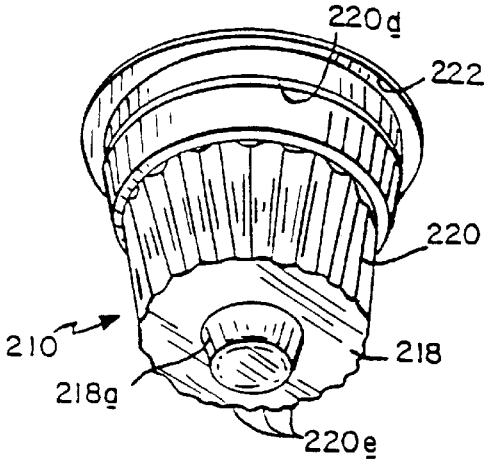
FIG. 9 is a bottom perspective view of a disposable filter cartridge in accordance with a second embodiment of the present invention.
Figure 10:
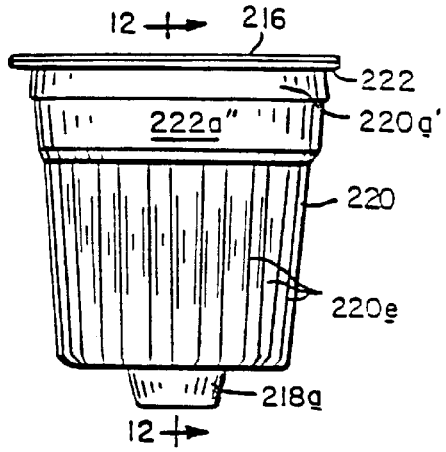
FIG. 10 is a side elevational view of the filter cartridge shown in FIG. 9.
Figure 12:
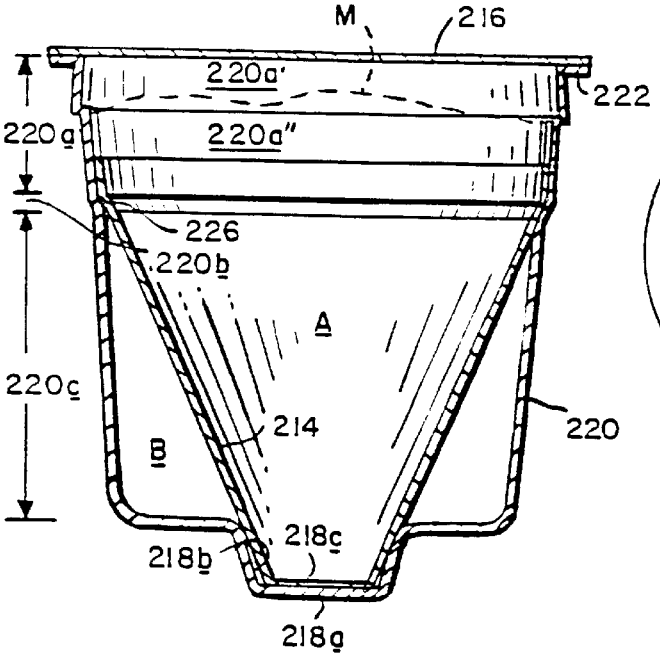
FIG. 12 is an enlarged cross sectional view taken along line 12—12 of FIG. 10.
Figure 11:
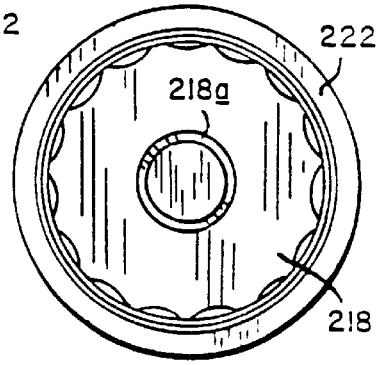
FIG. 11 is a bottom view of the filter cartridge shown in FIGS. 9 and 10.
Figure 13:
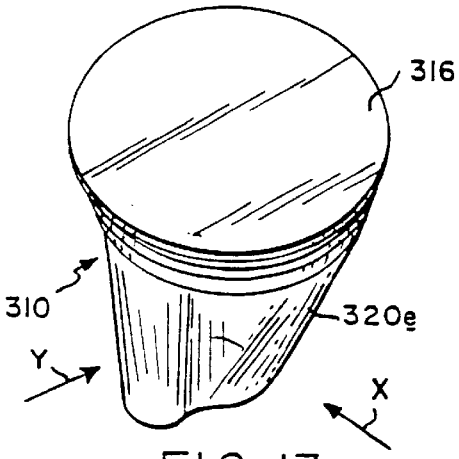
FIG. 13 is a perspective view of a disposable beverage filter cartridge in accordance with a third embodiment of the present invention.
Figure 15:
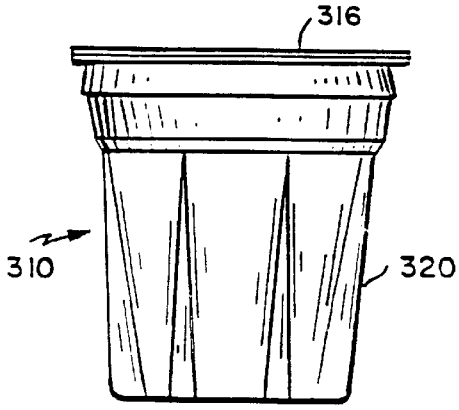
FIG. 15 is a side elevational view looking in the direction depicted by the arrow "x" in FIG. 13.
Figure 16:
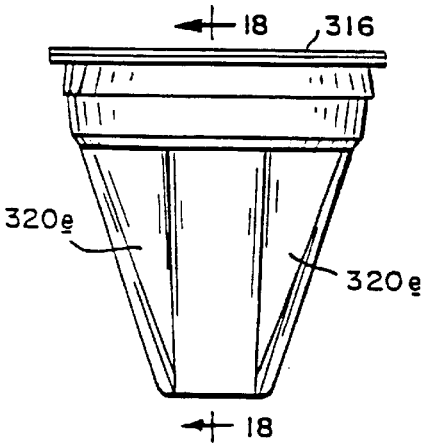
FIG. 16 is another side elevational view looking in the direction depicted by the arrow "Y" in FIG. 13.
Figure 14:
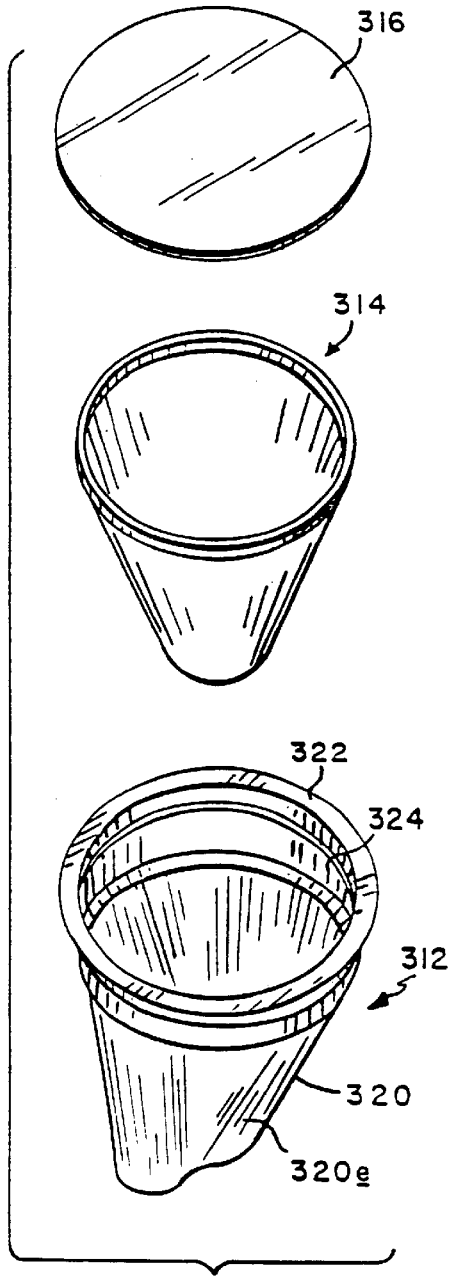
FIG. 14 is an exploded perspective view of the components of the beverage filter cartridge shown in FIG. 13.
Figure 17:
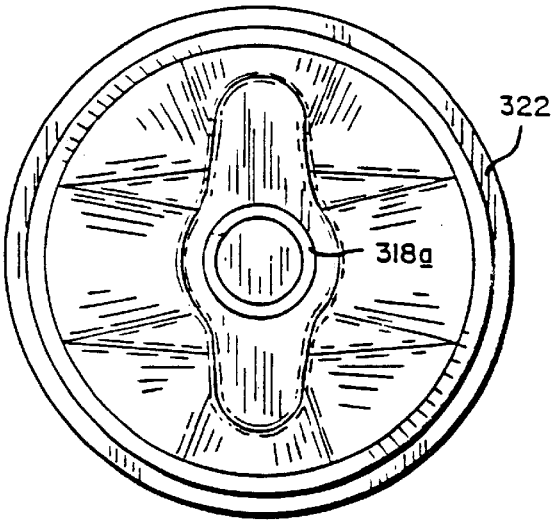
FIG. 17 is an enlarged bottom view of the beverage filter cartridge shown in FIGS. 13–16.
Figure 20:
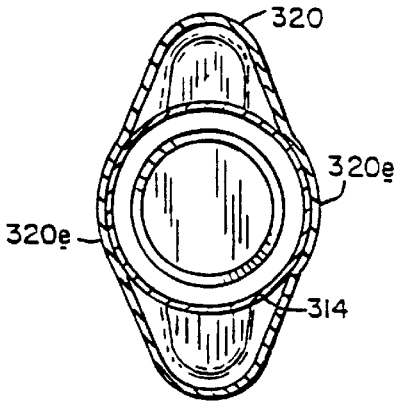
FIG. 20 is a horizontal sectional view taken along line 20—20 of FIG. 19.
Figure 18:
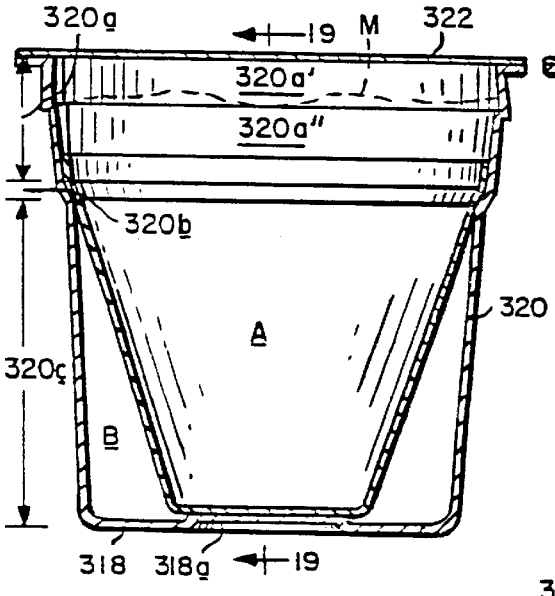
FIG. 18 is an enlarged vertical sectional view taken along line 18—18 of FIG. 16.
Figure 19:
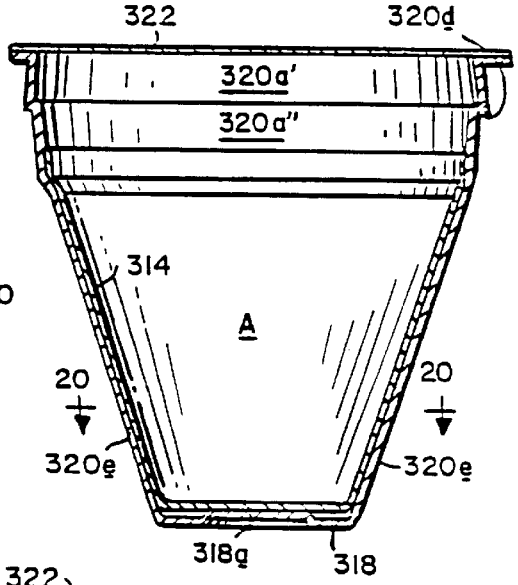
FIG. 19 is a vertical sectional view taken along line 19—19 of FIG. 18.
Figure 21:
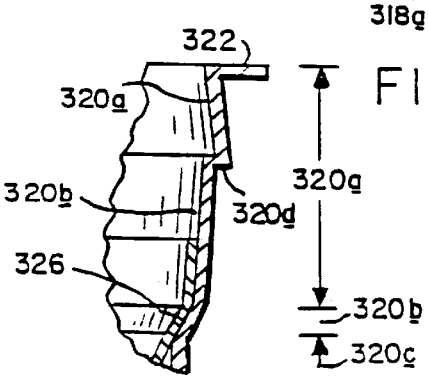
FIG. 21 is an enlarged sectional view of a rim portion of the cartridge as shown in FIGS. 18 and 19.

The second embodiment illustrated in FIGS. 9–11 is similar in many respects to the above-described first embodiment. Similar features of the second embodiment have been identified with similar reference numerals in a two hundred series. Thus, for example, reference numeral 10 identifies the filter cartridge of the first embodiment, and reference numeral 210 identifies the filter cartridge of the second embodiment.

In the second embodiment, the container bottom 218 is configured to provide a downwardly protruding centrally disposed reduced diameter boss 218*a* defining an interior sump 218*b* surrounded by an annular substantially planar bottom area. The bottom of the conical filter element is received in and secured to the bottom of the sump as at 218*c*.

The third embodiment illustrated in FIGS. 13–21 is also similar in many respects to the first embodiment. Again, similar features have been identified with similar reference numerals, but in a three hundred series.

The major difference between the first and third embodiments is that the latter has fewer and much deeper flutes 320*e*. As can be best seen in FIG. 19, the deeper flutes 320*e* contact and provide radial support for the filter element 314.

In light of the foregoing, it will now be appreciated by those skilled in the art that the present invention offers significant advantages over the known beverage filter cartridge described in the previously referenced patents. For example, the circumferentially spaced flutes 20*e*, 220*e* and 320*e* strengthen the container side wall against buckling when the bottom is pierced by the outlet probe 30. The deeper flutes 320*e* of the third embodiment offer the added advantage of radially supporting the filter element, which can be particularly beneficial during the processing cycle, when the filter element is being stressed by the infusion of pressurized heated liquid into the beverage medium.

In all embodiments, the downwardly diverging and gradually deepening of the flutes serves to promote downward flow of the brewed beverage in chamber B while beneficially encouraging turbulence. The upwardly protruding bosses 18*a*, 318*a* on the container bottoms of the first and third embodiments provide readily accessible support platforms for the bottoms of the filter elements. Securing the bottoms of the filter elements to the bosses 18*a*, 218*a* insures that the filter elements will not be punctured by the outlet probe 30.

The small diameter sump 218*b* defined by the downwardly protruding boss 218*a* of the second embodiment receives the lower end of the filter component in a confined space which beneficially decreases head space and further assists in positively locating and safeguarding the filter from damaging contact with the outlet probe.

The tapered ledges 20*b*, 220*b*, 320*b* of all embodiments provide distinct and readily accessible lands to which the filter elements may be reliably joined by heat sealing. The upper ends of the flutes 20*e*, 220*e*, 320*e* terminate below the ledges 20*b*, 220*b*, 320*b*, thereby insuring that the ledges are not interrupted by discontinuities that would be detrimental to the critical seal of the filter elements to the container side walls.

The upper container sections 20*a*, 220*a*, 320*a* above the filters provide beneficial increases in available storage capacity for the beverage medium. This increased storage capacity makes it unnecessary to fill the interior chamber A to its maximum capacity, thereby safeguarding the container rim from contamination by errant granules of the beverage medium.

Although the outer container and cover have been described as being formed from impermeable materials, it will be understood by those skilled in the art that, alternatively, permeable materials may be employed for one or both of these components. Where permeable materials are employed, the completed cartridges will preferably be subsequently enclosed, either individually or in batches, with impermeable wrappings. Materials for such wrappings are well known, and include for example EVOH films, aluminum foil, etc.

Although the present invention has been described with reference to several embodiments, various changes, modifications and additions may be made without departing from the spirit and scope of the appended claims.

We claim:

1. A beverage filter cartridge comprising:

a cup-shaped outer container having a bottom wall and a side wall extending from said bottom wall to a circular rim surrounding an upper opening, said side wall having an upper section extending downwardly from said rim to an inwardly tapered ledge, and having a tapered lower section extending downwardly from said inwardly tapered ledge to said bottom wall;

a generally cone shaped filter element received in said container, said filter element having a closed lower end supported on and secured to said bottom wall, and having an upwardly diverging wall with an open upper end supported on and secured to said inwardly tapered ledge, said filter element being configured and positioned to subdivide the interior of said container into first and second chambers;

a beverage medium stored in said first chamber; and a cover joined to said side wall at said rim and closing said upper opening, said cover being piercable to accommodate an injection of liquid into said first chamber for combination with said beverage medium to produce a beverage, said filter element being permeable to accommodate a flow of said beverage from said first chamber into said second chamber, and said bottom wall being piercable to accommodate an outflow of said beverage from said second chamber to the exterior of said cartridge.

2. The beverage filter cartridge of claim 1 wherein the taper angle of said ledge is greater than the taper angle of said lower section.

3. The beverage filter cartridge of claim 1 wherein said upper section has an upper segment extending downwardly from said circular rim and a lower segment extending upwardly from said ledge, said upper segment being flared outwardly and said lower segment being tapered inwardly, with the juncture of said upper and lower segments defining an exterior stacking shoulder.

4. The beverage filter cartridge of any one of claims 1–3 wherein the taper angle of said ledge approximates the taper angle of said filter element.

5. The beverage filter cartridge of claim 1 wherein said outer container is impermeable to liquids and gases.

6. The beverage filter cartridge of claim 1 wherein said lid is impermeable to liquids and gases.

7. The beverage filter cartridge of claim 1 wherein said bottom wall is provided with an upwardly protruding centrally disposed boss, the lower end of said filter element being supported on said boss.

8. The beverage filter cartridge of claim 7 wherein the lower end of said filter is secured to said boss.

* * * * *